US011317669B1

(12) United States Patent
Curry

(10) Patent No.: US 11,317,669 B1
(45) Date of Patent: May 3, 2022

(54) HAT SHAPING DEVICE

(71) Applicant: Cover Keeper, LLC, North Las Vegas, NV (US)

(72) Inventor: Ryan Kevin Curry, Annapolis, MD (US)

(73) Assignee: COVER KEEPER, LLC, North Las Vegas, NV (US)

( * ) Notice: Subject to any disclaimer, the term of this patent is extended or adjusted under 35 U.S.C. 154(b) by 0 days.

(21) Appl. No.: 17/516,005

(22) Filed: Nov. 1, 2021

Related U.S. Application Data

(60) Provisional application No. 63/158,027, filed on Mar. 8, 2021.

(51) Int. Cl.
*A42B 1/002* (2021.01)

(52) U.S. Cl.
CPC ..... *A42B 1/002* (2013.01)

(58) Field of Classification Search
CPC ..... A42B 1/002; A47G 25/10; A42C 1/04
USPC ..... 223/12, 15
See application file for complete search history.

(56) References Cited

U.S. PATENT DOCUMENTS 815,893 A * 3/1906 Adams ..... A47G 25/10 211/32
961,418 A * 6/1910 Lloyd ..... A42C 3/00 223/25
1,541,133 A * 6/1925 Forti ..... A42B 1/002 223/25
1,703,398 A * 2/1929 Lake ..... A42B 1/002 223/24
2,107,961 A * 2/1938 Seiler ..... D06F 59/02 223/25
2,935,237 A * 5/1960 Seiler ..... A42C 3/00 223/25
3,459,347 A * 8/1969 Navara ..... A42B 1/002 223/25
4,011,973 A * 3/1977 Leach ..... A42B 1/002 223/84
4,673,113 A * 6/1987 Vandewege ..... A42C 3/00 223/15
4,708,271 A * 11/1987 Grommes ..... A42B 1/002 211/32
4,739,909 A * 4/1988 Bury ..... A42B 1/002 223/15
5,094,369 A * 3/1992 Thompson ..... A42B 1/002 223/15
6,234,367 B1 * 5/2001 McCallister ..... A42B 1/002 223/24
9,161,599 B1 * 10/2015 Shelton ..... A45C 13/02
2010/0193550 A1 * 8/2010 Bittner ..... A47F 7/06 223/15

* cited by examiner

*Primary Examiner* — F Griffin Hall
(74) *Attorney, Agent, or Firm* — Kolitch Romano LLP

(57) ABSTRACT

A hat shaping device is configured to be installed on headwear (e.g., on a band of a peaked cap) to urge the headwear into an oblong and/or oval shape. The device includes a pair of hooks connected together in a manner that allows the device to be transitioned between a deployed configuration, in which the device is configured for installation on the headwear, and a stowed configuration, in which the device is configured for easy storage and/or transport. In some examples, the device is collapsed when in the stowed configuration (e.g., with respective legs of the pair of hooks nested together one on top of the other.)

11 Claims, 14 Drawing Sheets

HAT SHAPING DEVICE

CROSS-REFERENCES

The following applications and materials are incorporated herein, in their entireties, for all purposes: U.S. Provisional Patent Application Ser. No. 63/158,027, filed Mar. 8, 2021.

FIELD

This disclosure relates to systems and methods for holding the shape of hats.

INTRODUCTION

Peaked caps and similar hats are often worn by members of the military, law enforcement community, marching bands, and others. These hats have a known issue wherein the band surrounding the wearer's head is quite stiff and generally circular (e.g., due to being manufactured with a circular shape and/or naturally developing a circular shape over time). However, a human head has a generally oval shape where the hat contacts it, leading to a mismatch between the headgear and the head. This can be quite uncomfortable when worn, as the circular shape of the hat places a disproportionately greater pressure on the front and rear of the head.

SUMMARY

The present disclosure provides systems, apparatuses, and methods relating to holding the shape of hats.

In some examples, a device for maintaining a shape of a hat band may include a pair of hooks each comprising a leg portion and a hook portion extending from a distal end of the respective leg portion; wherein the leg portions are configured to be coupled to each other at respective proximal ends by a joint such that the hooks are transitionable between a deployed configuration, wherein the leg portions extend in opposing directions from the joint, and a stowed configuration, wherein the leg portions extend in a same direction from the joint.

In some examples, a collapsible device for urging a hat band into an oblong shape may include a first hook having a first leg and a first hook portion extending transversely from a distal end of the first leg; and a second hook having a second leg and a second hook portion extending transversely from a distal end of the second leg; wherein proximal ends of the first and second legs are configured to be coupled together by a pivoting joint, such that the first and second hooks are configured to pivotably transition between a first configuration, wherein the first and second legs are oriented antiparallel to each other, and a second configuration, wherein the first and second legs are oriented at an angle of less than 90 degrees relative to each other.

In some examples, a device for maintaining a shape of a cap band may include a first hook including a first leg portion and a first means for engaging a band of a cap; a second hook including a second leg portion and a second means for engaging the band of the cap; and means for coupling the first leg portion to the second leg portion such that the first and second hooks are collectively transitionable between a deployed configuration and a collapsed configuration.

Features, functions, and advantages may be achieved independently in various embodiments of the present disclosure, or may be combined in yet other embodiments, further details of which can be seen with reference to the following description and drawings.

DETAILED DESCRIPTION

Figure 1:
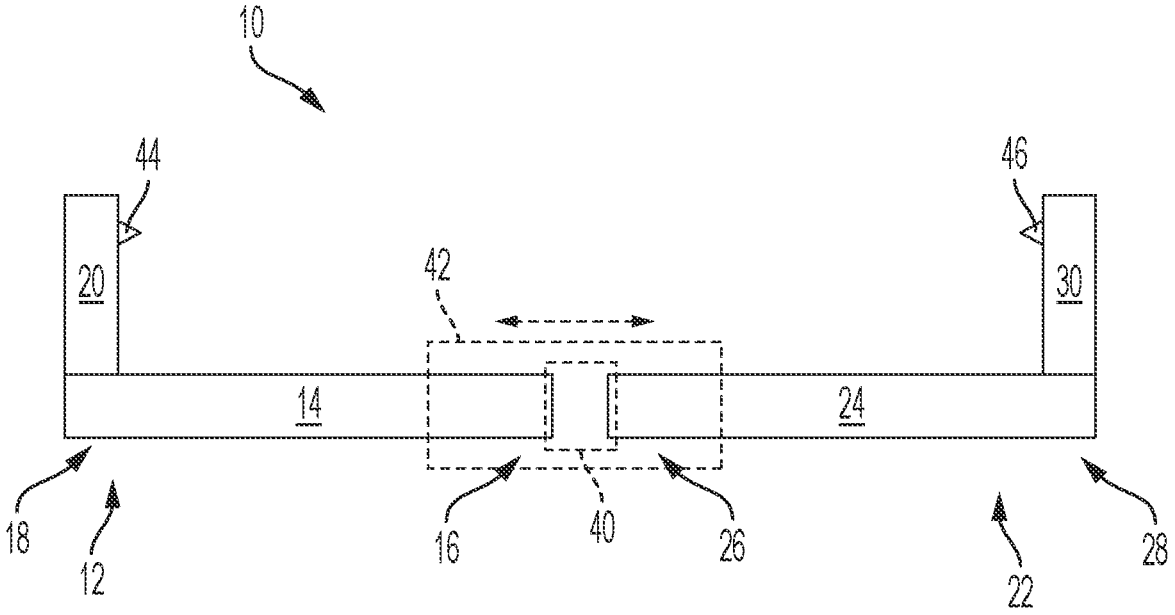
FIG. 1 is a schematic side view of a hat shaping device in accordance with aspects of the present disclosure.

Various aspects and examples of a collapsible, portable storage device configured to establish and/or maintain the shape of the band of a peaked cap, as well as related methods, are described below and illustrated in the associated drawings. Unless otherwise specified, a hat shaping device in accordance with the present teachings, and/or its various components, may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Advantages, Features, and Benefits; and (5) Conclusion. The Examples, Components, and Alternatives section is further divided into subsections, each of which is labeled accordingly.

Definitions

The following definitions apply herein, unless otherwise indicated.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"AKA" means "also known as," and may be used to indicate an alternative or corresponding term for a given element or elements.

"Elongate" or "elongated" refers to an object or aperture that has a length greater than its own width, although the width need not be uniform. For example, an elongate slot may be elliptical or stadium-shaped, and an elongate candlestick may have a height greater than its tapering diameter. As a negative example, a circular aperture would not be considered an elongate aperture.

"Coupled" means connected, either permanently or releasably, whether directly or indirectly through intervening components.

"Resilient" describes a material or structure configured to respond to normal operating loads (e.g., when compressed) by deforming elastically and returning to an original shape or position when unloaded.

"Rigid" describes a material or structure configured to be stiff, non-deformable, or substantially lacking in flexibility under normal operating conditions.

"Elastic" describes a material or structure configured to spontaneously resume its former shape after being stretched or expanded.

"Providing," in the context of a method, may include receiving, obtaining, purchasing, manufacturing, generating, processing, preprocessing, and/or the like, such that the object or material provided is in a state and configuration for other steps to be carried out.

In this disclosure, one or more publications, patents, and/or patent applications may be incorporated by reference. However, such material is only incorporated to the extent that no conflict exists between the incorporated material and the statements and drawings set forth herein. In the event of any such conflict, including any conflict in terminology, the present disclosure is controlling.

Overview

In general, the present disclosure describes a device for holding the shape of a peaked cap and/or other suitable headwear when the peaked cap is not in use. Peaked caps typically have a flexible but inelastic band configured to at least partially surround a wearer's head. The band is made of stiff natural and/or synthetic material(s), and the construction of the hat causes the band to naturally become overly rounded as compared with the generally oval cross-sectional shape of a human head. Due to the materials used and the construction of the hat, the band also tends (whether slowly or quickly) to return to this overly rounded shape after being worn or otherwise deformed from its original rounded shape. To combat this issue, users have created homemade storage solutions to squeeze the hat into a more oval shape, such that the hat will be pre-shaped into the more comfortable oval shape when donned. These homemade solutions generally include things like a bent wire coat hanger or a rubber band used to connect buttons on opposing sides of the band.

Hat shaping devices disclosed herein include a pair of L-shaped hooks having proximal ends releasably coupled to each other at an adjustable-length joint. In some examples, the joint of the hat shaping device is a pivotable joint. In some examples, the device is transitionable between a stowed configuration, in which the two hooks are nested together, and a deployed configuration, in which the hooks are extended in line with each other to form a generally U-shaped apparatus. The U-shaped hat shaping device is sized and configured to easily clamp onto the band of a peaked cap, forcing it into a narrower shape. Transitioning between the configurations may include pivoting one or both of the L-shaped hooks. The adjustable-length mechanism may include, e.g., selectable pin and socket joints, with or without an interlock feature.

When in the deployed configuration, the distal ends of the hooks may be placed on respective lateral sides of a hat or cap, such that the hooks squeeze the naturally rounded band of the hat into a more desired oval shape. The tendency for the lateral sides of the band of a peaked cap to move away from each other exerts an outward force on the hooks of the hat shaping device and holds the device in place. The hat shaping device causes the shape of the band to more closely resemble that of a human head, and the relatively stiff band of the peaked cap will hold the desired oval shape for some time after removal of the hat shaping device. Storing the cap with the hat shaping device installed facilitates the desired shape of the band and enhances the comfort of the eventual wearer.

When wearing the cap, a user can transition the hat shaping device into the stowed configuration, and either pocket the device (e.g., in a pocket of the wearer's uniform) or tuck the device into the brim inside the cap. In this manner, the hat shaping device can easily be transported in an unobtrusive manner, allowing the user to, e.g., reuse the device to store the cap in the future. Alternatively, the stowed device can be stored in any other suitable location, such as an external storage container.

Additionally, the purpose-built device provides a professional aesthetic more appropriate for military and public use than known solutions, such as bent wire coat hangers and rubber bands.

Examples, Components, and Alternatives

The following sections describe selected aspects of illustrative hat shaping devices, as well as related systems and/or methods. The examples in these sections are intended for illustration and should not be interpreted as limiting the scope of the present disclosure. Each section may include one or more distinct embodiments or examples, and/or contextual or related information, function, and/or structure.

A. Schematic Hat Shaping Device

Figure 2:
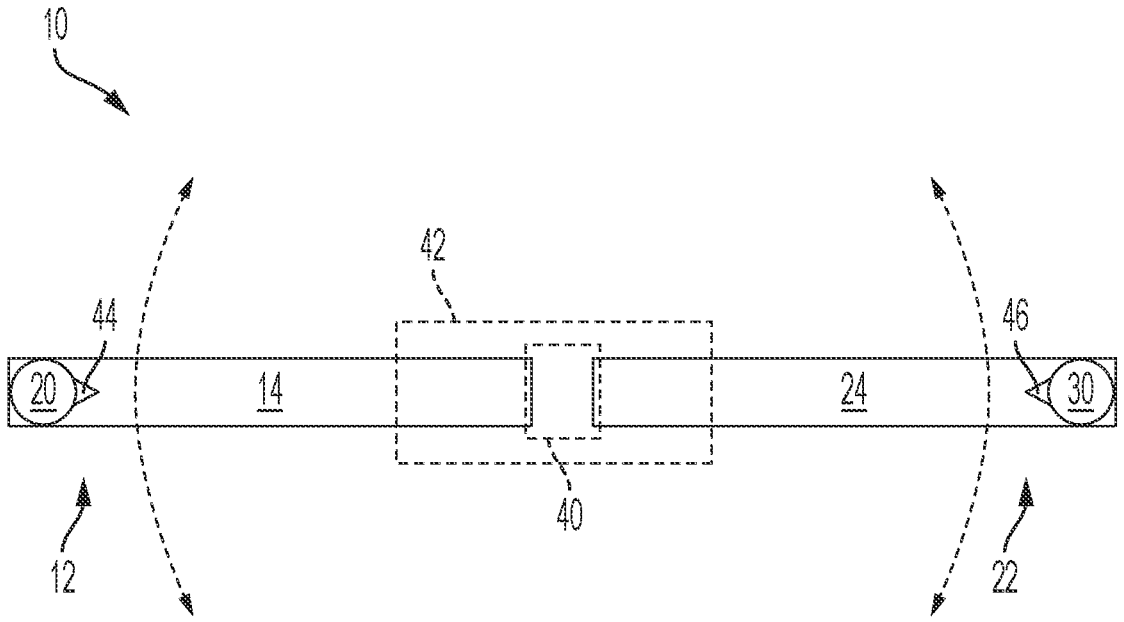
FIG. 2 is a schematic top view of the hat shaping device of FIG. 1.
Figure 3:
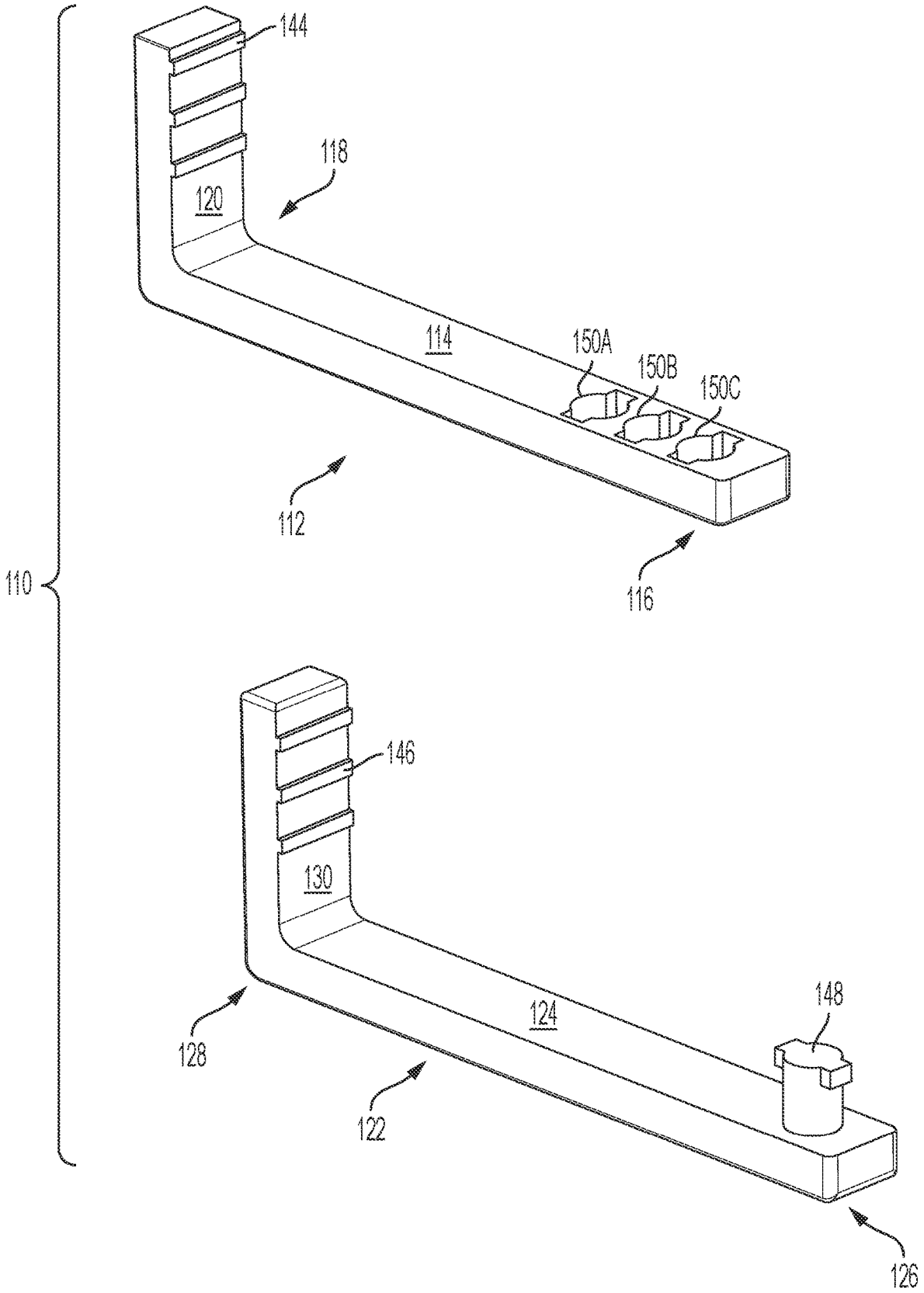
FIG. 3 is an isometric view of an illustrative hat shaping device in accordance with aspects of the present disclosure, depicted in a disassembled configuration.

As shown in FIGS. 1-2, this section describes an illustrative hat shaping device 10, which is an example of the devices described above. FIG. 1 is a schematic side view of the device, and FIG. 2 is a schematic top view of the device.

Device 10 includes a first hook 12 having a leg 14 having a proximal end 16 and a distal end 18, and a first hook portion 20 extending transversely from distal end 18. A second hook 22 includes a leg 24 having a proximal end 26 and a distal end 28, and a second hook portion 30 extending transversely from distal end 28.

Proximal ends 16 and 26 are removably coupled together by a joint 40. Device 10 further includes an adjustable-length mechanism 42 configured to facilitate adjustment of an overall width of the device (e.g., a width between distal end 18 and distal end 28). Adjustable-length mechanism 42 is described further below.

Legs 14 and 24 may include any suitable rigid structures configured to, in combination, span a width of a band of a peaked cap. In some examples, legs 14 and 24 are elongate members comprising a rigid plastic material. Alternatively, or additionally, the legs may comprise a rigid metal and/or any other suitable material(s).

Hook portions 20 and 30 extend transversely (e.g., orthogonally) from respective distal ends 18, 28 of the legs, and may include any suitable rigid structures configured to interface with lateral sides of the band and exert force thereon. Hook portions 20 and 30 may be coupled to legs 14 and 24 in any suitable manner, such as by fastening. In some examples, the leg and corresponding hook portion are formed as a single piece (e.g., by additive manufacturing, injection molding, machining, and/or any other suitable method(s)). Hook portions 20 and 30 may have any suitable shape and size suitable to interface with the lateral sides of the band.

Optionally, the hook portions may further include one or more gripping structures, such as gripping structure 44 on hook portion 20 and gripping structure 46 on hook portion 30 of the example depicted in FIG. 1. Gripping structures 44 and 46 may include any suitable structure configured to enhance the secure engagement of the hook portions with the sides of the band when installed, such as texturing, shaping, or roughening; one or more ribs, barbs, or castellations; one or more recesses in face(s) of the hook portions; etc. In some examples, gripping structures are fastened to the hook portions. In some examples, gripping structures are formed as part of the hook portions.

Joint 40 may include any suitable connection between first hook 12 and second hook 22. For example, joint 40 may include a releasable pivot joint or a nested telescoping joint. In some examples, joint 40 includes a male/female joint having an aperture in one leg and an insertable pin extending from the other leg. Joint 40 may include an interlock feature configured to prevent inadvertent uncoupling of the legs from each other.

In some examples, joint 40 is pivotable (see, e.g., FIG. 2, where the dashed arrows depict illustrative pivoting movement of the hooks). In some cases, joint 40 is pivotable in such a way as to enable the legs to fold onto each other in a nesting (AKA stowed) configuration.

Adjustable-length mechanism 42 may include any suitable mechanism configured to allow a user to change the overall effective width of the device, with the goal of accommodating different hat sizes and/or achieving a desired magnitude of the squeezing effect. In some examples, the legs fit into each other with a telescoping connection. In these examples, overall width may be changed by way of a clamping and/or stopping device configured to secure the legs to each other at a selected position. Detents and/or spring-loaded button-and-hole mechanisms may be utilized (e.g., at predetermined discrete locations) to secure the legs. In some examples, a pin-and-socket mechanism or other suitable mechanism for connecting the first and second hooks includes an adjustable length feature by way of providing a plurality of spaced apart sockets or apertures to choose from.

B. Illustrative Hat Shaping Device

As shown in FIGS. 3-9, 15-17, and 18-23, this section describes an illustrative hat shaping device 110, which is an example of device 10.

FIGS. 3-9 depict various views of device 110. Device 110 includes a first hook 112 having a leg 114 having a proximal end 116 and a distal end 118, and a first hook portion 120 extending transversely from distal end 118. A second hook 122 includes a leg 124 having a proximal end 126 and a distal end 128, and a second hook portion 130 extending transversely from distal end 128. Proximal ends 116 and 126 are removably coupled together by a joint 140 which includes an adjustable-length mechanism 142.

In this example, hook portions 120 and 130 extend orthogonally from the distal ends of legs 114 and 124 respectively and are configured to interface with lateral sides of a band of a cap or other suitable headwear and exert force thereon. Hook portions 120 and 130 are each formed as a single piece with their respective legs (e.g., by additive manufacturing, injection molding, machining, etc.). In other words, each leg and hook portion is a unitary structure. In some examples, hook portions 120 and 130 are not formed as a single piece with their respective legs and are coupled to the distal ends of the legs by another suitable mechanism, such as fastener(s).

In this example, the leg and hook portions have a generally rectangular cross section. Any suitable cross-sectional shape(s) may be utilized for the leg and hook portions, such as round, square, polygonal, trapezoidal, etc. In some examples, the leg and hook portions of the first hook have different cross sections from each other and/or from cross section(s) of the leg and/or hook portions of the second hook.

Hook portions 120 and 130 include gripping structures 144 on hook portion 120 and gripping structures 146 on hook portion 130. Gripping structures 144 and 146 each include a plurality of spaced-apart ribs oriented across a width of an inner face of the hook portion. Other gripping structures may be utilized, either in addition to or instead of ribs.

Figure 15:
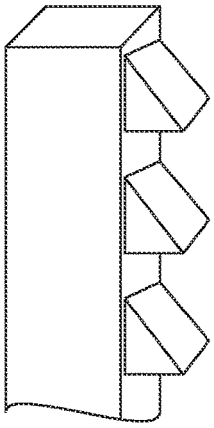
FIG. 15 is a partial isometric view of yet another illustrative hat shaping device in accordance with aspects of the present disclosure.
Figure 16:
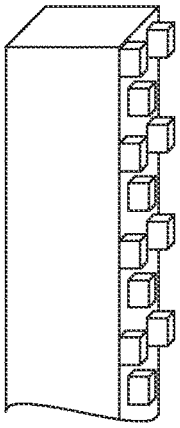
FIG. 16 is a partial isometric view of yet another illustrative hat shaping device in accordance with aspects of the present disclosure.
Figure 17:
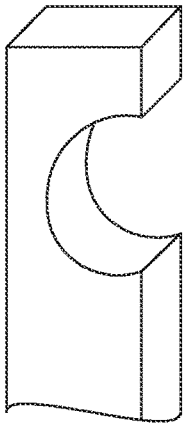
FIG. 17 is a partial isometric view of yet another illustrative hat shaping device in accordance with aspects of the present disclosure.

FIGS. 15-17 depict illustrative gripping portions that may be suitable for use in device 110 and/or other suitable hat shaping devices. FIG. 15 depicts a gripping structure comprising a plurality of evenly spaced-apart prism-shaped ribs each extending across the width of the inner face of the hook portion. FIG. 16 depicts a gripping structure comprising a plurality of convex protrusions disposed in a pattern of offset rows. In the example depicted in FIG. 16, the pattern includes first rows each having two evenly spaced protrusions alternating with second rows each having one protrusion aligned with a gap between the two protrusions of the respective adjacent first rows). In other examples, the protrusions may be disposed in any other suitable pattern. In the depicted example, the protrusions comprise rectangular blocks, but in other examples the protrusions may additionally or alternatively comprise any other suitable shape(s).

FIG. 17 depicts a gripping structure comprising a concave recess in an otherwise flat surface of an inner face of a hook portion. The recess is configured to receive and/or mate with an outer surface of the band of the cap. The recess can have any suitable shape to grab on to the band, such as cylindrical (as in the depicted example), cuboidal, polygonal, rectangular, etc. In some examples, a hook portion includes a concave recess as well as one or more protrusions (e.g., disposed adjacent the recess).

Figure 4:
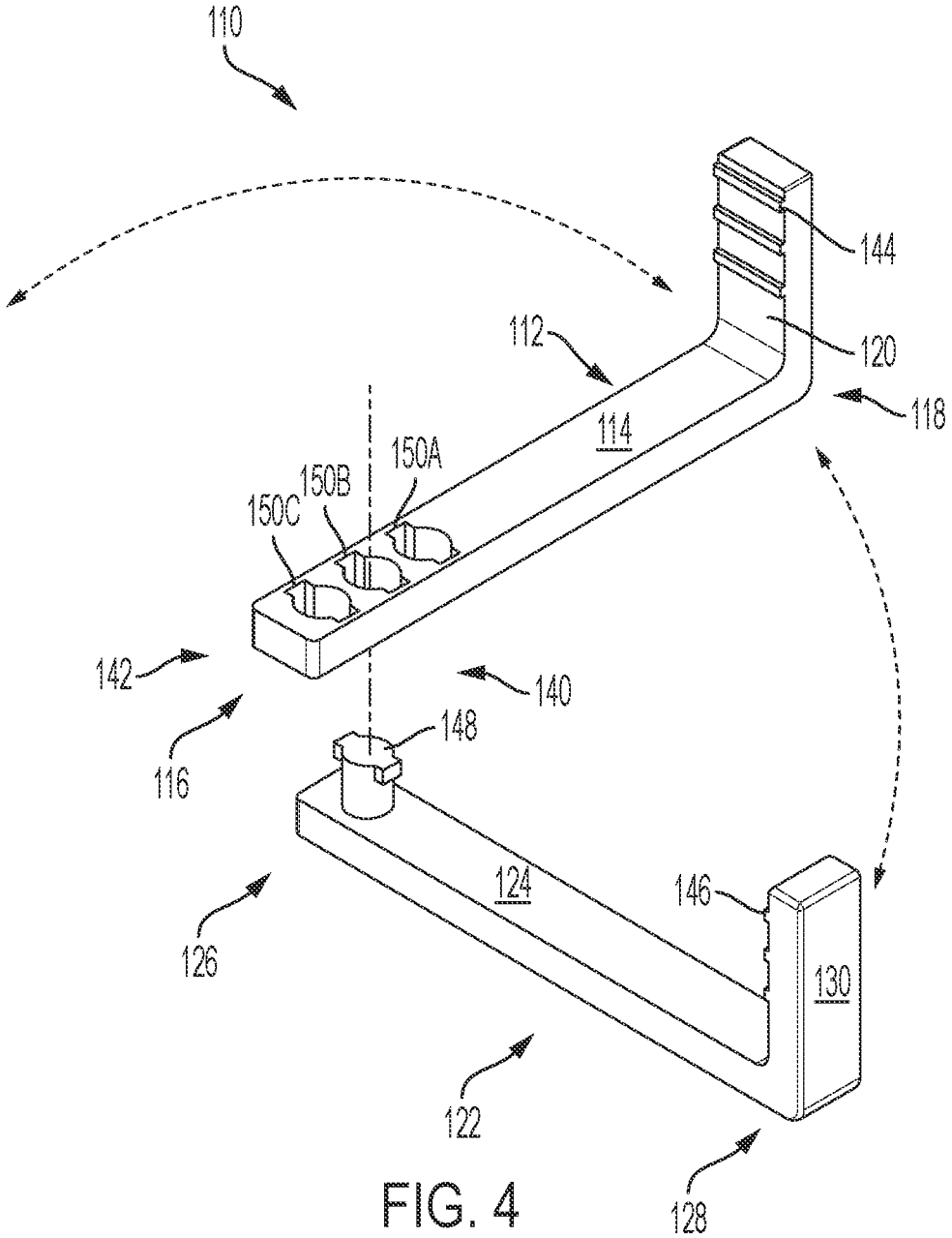
FIG. 4 is an isometric view of the device of FIG. 3, showing an illustrative interaction between components of the device.

Returning to FIGS. 3-9, joint 140 and adjustable-length mechanism 142 comprise an adjustable, releasable, keyed pivot joint formed by a T-shaped pin 148 protruding from leg 124 and a plurality of selectable apertures 150A, 150B, 150C each having a corresponding shape and disposed on the proximal end of leg 114. When long axes of legs 114 and 124 are aligned (see FIGS. 8-9), the T shape of pin 148 is oriented 90 degrees from the T-shaped opening of apertures 150A-C, such that the pin and socket joint is prevented from separating unless the legs are pivoted to form a 90-degree angle relative to each other. When the legs are oriented at 90 degrees relative to each other (see FIG. 4, depicting an exploded view), the T shape of pin 148 is aligned with the T-shaped opening of aperture 150A, 150B, 150C, such that the pin and socket joint can be separated. This interlock feature prevents inadvertent uncoupling of the legs from each other and allows intentional uncoupling. In some examples, more or fewer apertures may be provided on leg 114.

Figure 5:
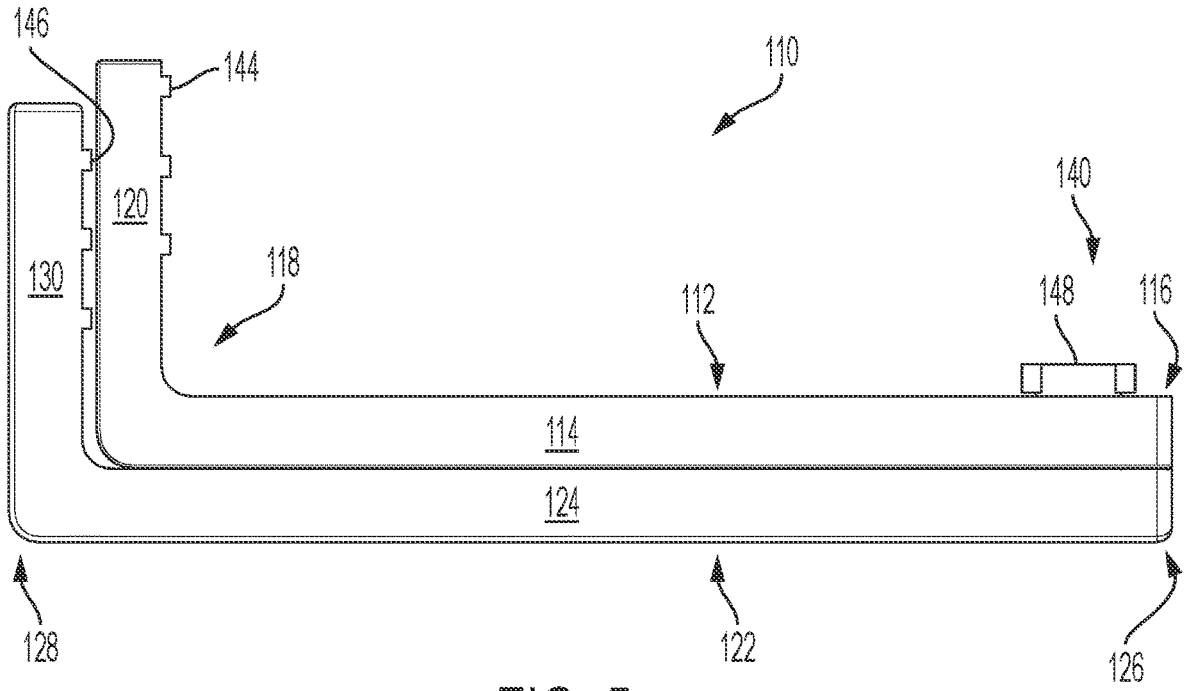
FIG. 5 is a side view of the device of FIG. 3, depicting the device in a stowed configuration.
Figure 6:
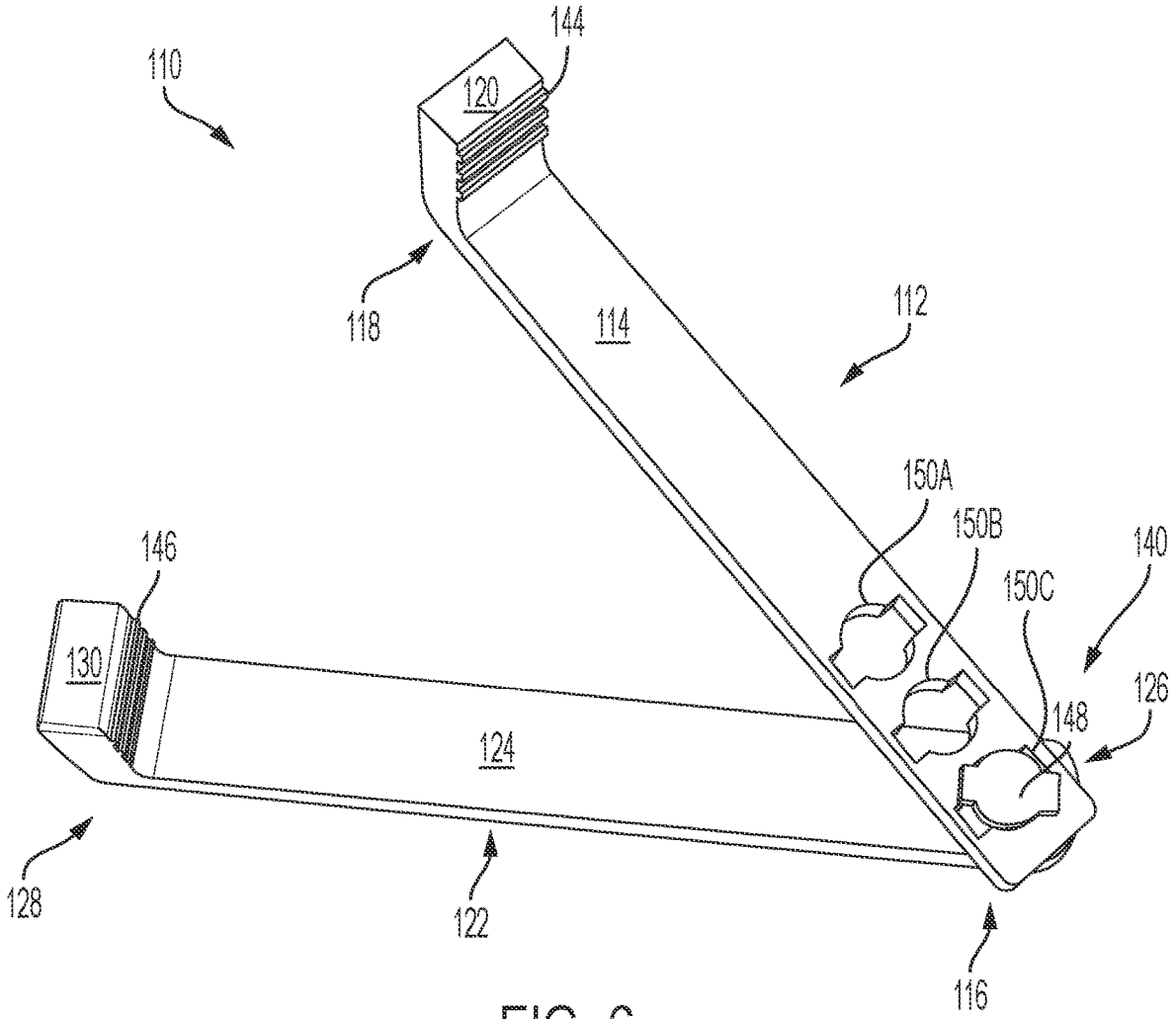
FIG. 6 is an isometric top view of the device of FIG. 3, depicting the device in a partially collapsed configuration.
Figure 7:
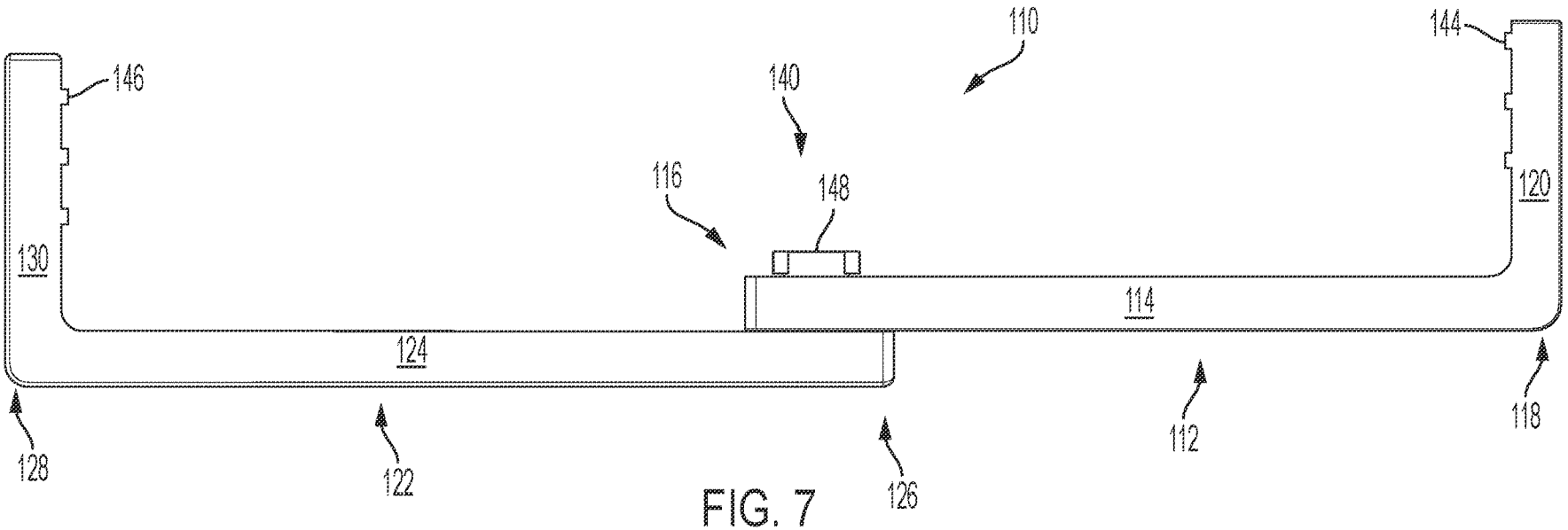
FIG. 7 is another side view of the device of FIG. 3, depicting the device in a deployed configuration.
Figure 8:
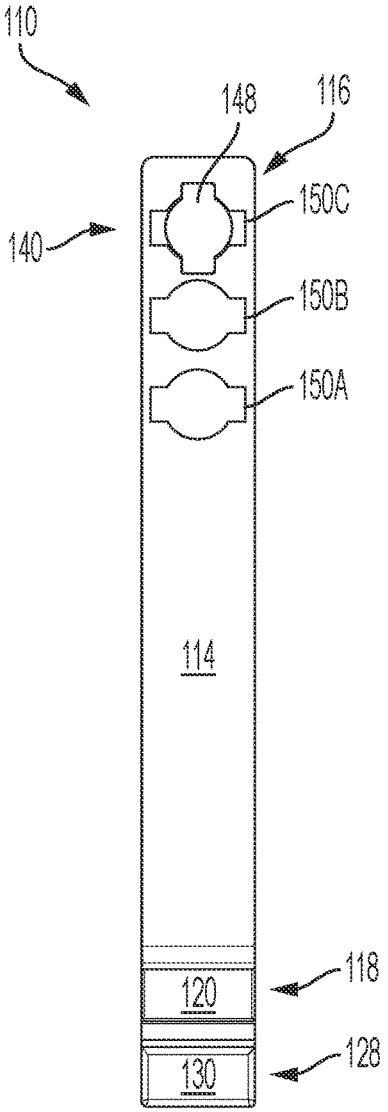
FIG. 8 is a top view of the device of FIG. 3, depicting the device in the stowed configuration.
Figure 9:
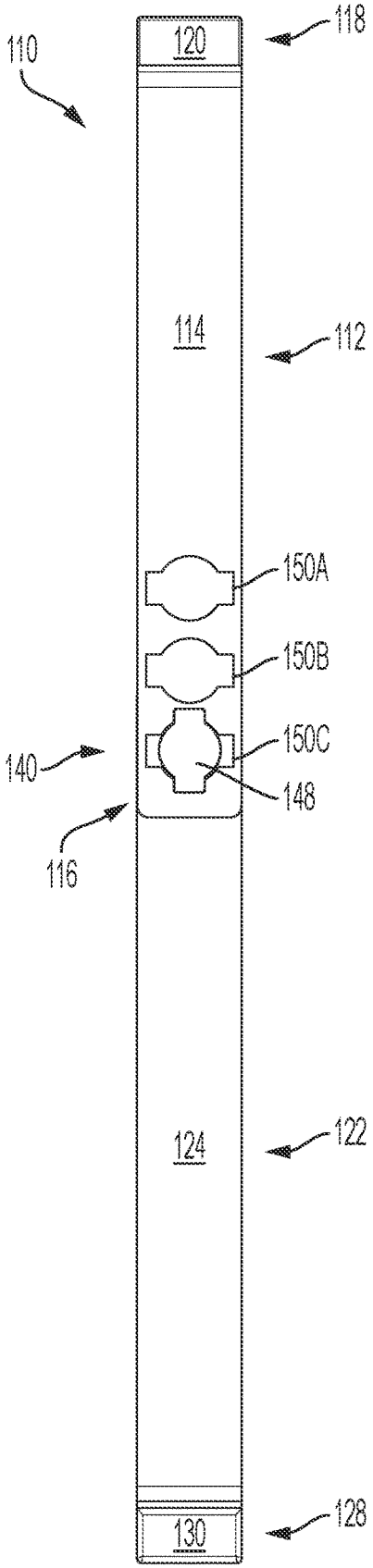
FIG. 9 is another top view of the device of FIG. 3, depicting the device in the deployed configuration.

The mechanism of joint 140 allows the legs to be disposed one atop the other, such that the joint is pivotable to enable the legs to fold onto each other in a nesting (AKA stowed) configuration (see FIG. 5 and FIG. 8). In some examples, the leg lengths are such that proximal ends 116 and 126 are aligned when nested. From the stowed configuration, the device can be transitioned to a deployed configuration in which the legs are oriented generally anti-parallel to each other (e.g., legs 114 and 124 extend in opposing directions; see FIG. 7 and FIG. 9). In the deployed configuration, the device can be installed on the cap to impart and/or maintain a desired hat shape.

When hooks 112, 122 are decoupled from each other, device 110 can be assembled by orienting the hooks at a 90 degree angle, such that the T shape of pin 148 is aligned with one of T-shaped apertures 150A, 150B, 150C, and inserting the pin into the selected aperture. From this point, the device can be transitioned to the deployed configuration by rotating one or both hooks to separate the hooks by 180 degrees, or to the stowed configuration by rotating one or both hooks to separate the hooks by 0 degrees, such that one hook is nested on top of the other.

Turning now to FIGS. 18-23, illustrative installation and storage of hat shaping device 110 will now be described with respect to an illustrative peaked cap 200. Cap 200 includes a visor 202 extending from a band 204, which forms the lower portion of the hat. A crown 206 extends upward from band 204. A chinstrap 208 is held to band 204 by a pair of screw-on buttons 210.

Figure 18:
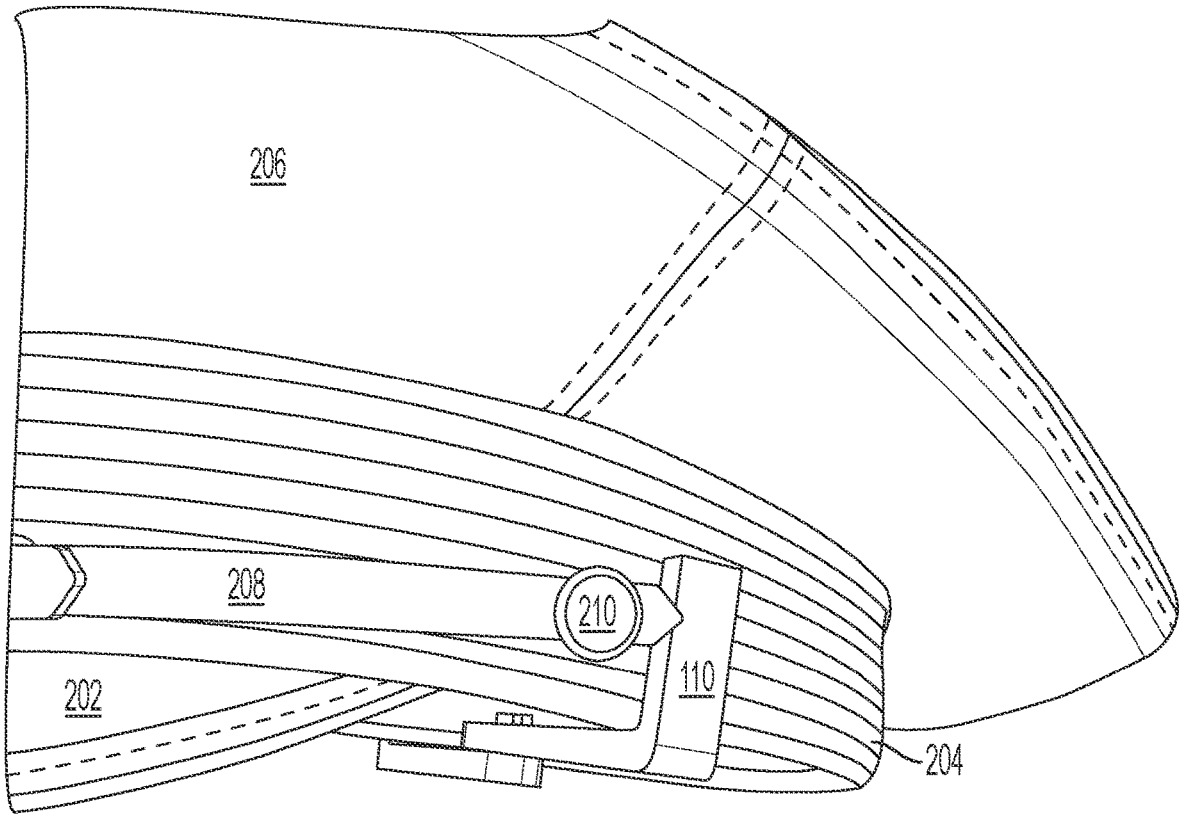
FIG. 18 is an oblique partial side view of the hat shaping device of FIG. 3, depicting the device installed on a peaked cap.

Hat shaping device 110 in the deployed configuration can be installed on cap 200 to establish and/or preserve an oval shape of band 204. FIG. 18 depicts how device 110 may be installed on this particular style of cap, with the hook portions of device 110 extending up the sides of band 204 immediately to the rear of buttons 210.

Figure 19:
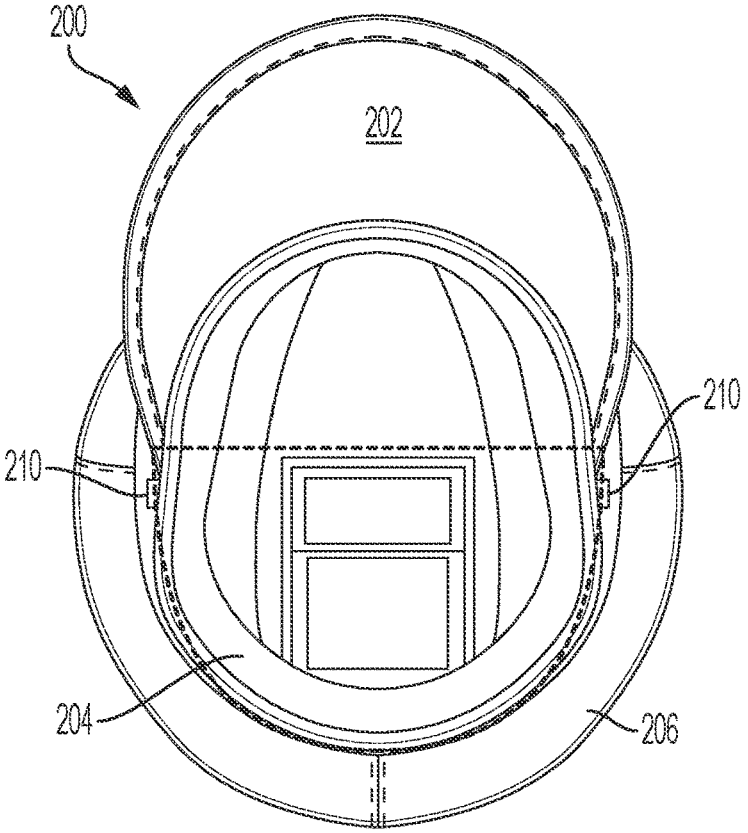
FIG. 19 is a bottom view of the peaked cap of FIG. 18 prior to installation of the hat shaping device.
Figure 20:
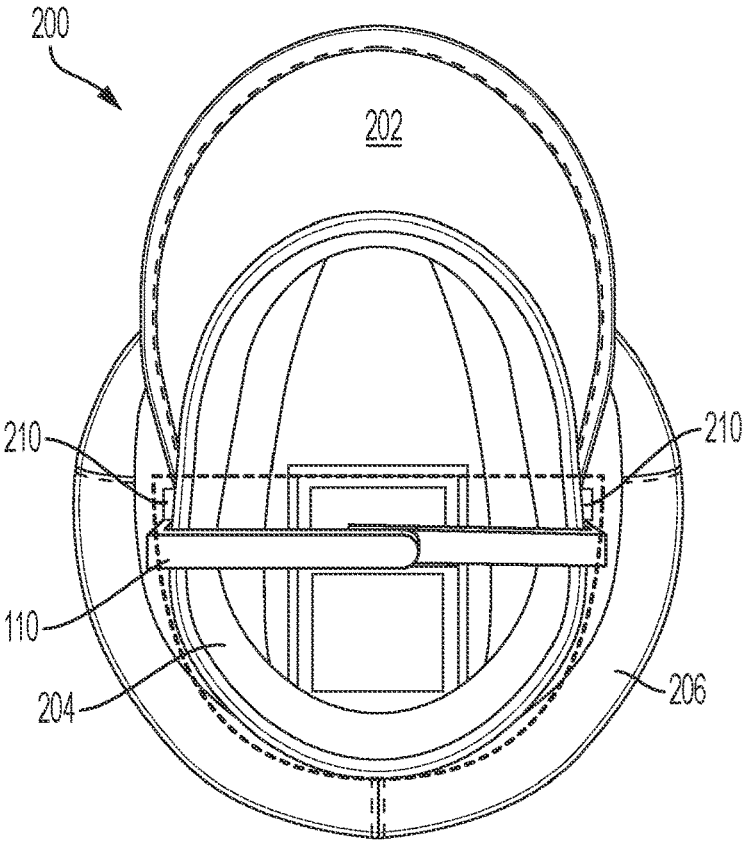
FIG. 20 is another bottom view of the peaked cap of FIG. 18, depicting the hat-shaping device of FIG. 3 installed in the peaked cap.

FIG. 19 shows cap 200 in its unfettered, rounded shape, which is uncomfortable on a typical wearer's head. The dashed line in this figure generally traces the circular rear portion of the head opening. FIG. 20 depicts the cap with hat shaping device 110 installed, showing how the band is squeezed into a more comfortable shape (e.g., a shape conforming better to the wearer's anatomy) by device 110. The dashed lines from FIG. 19 depicting the rounded shape of the uncorrected hat remain in place in FIG. 20 to help illustrate the change in band shape.

Figure 21:
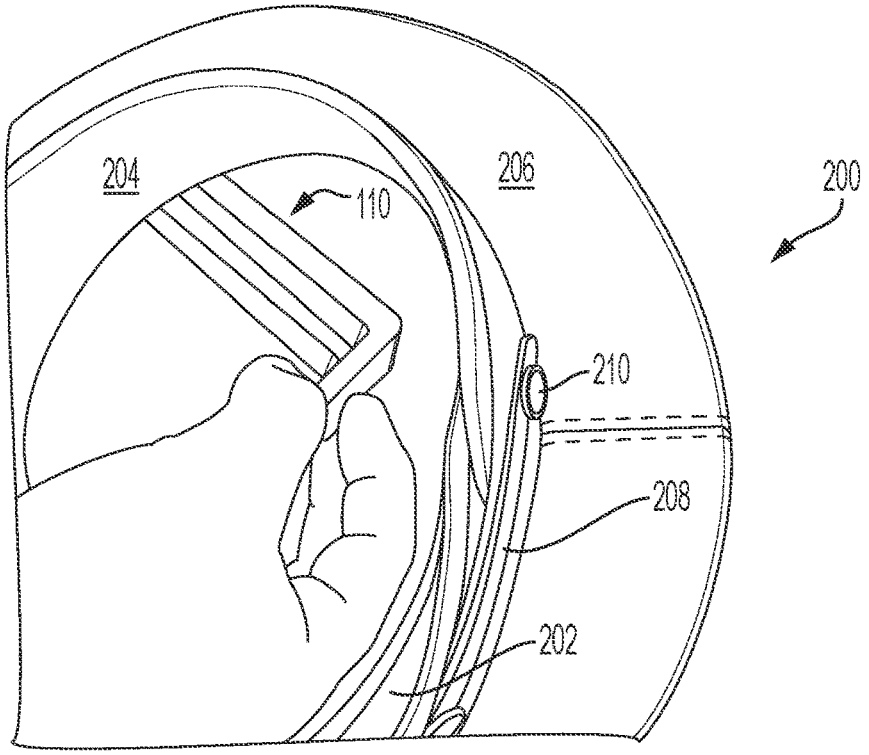
FIG. 21 is an oblique bottom view depicting a step in an illustrative method for securely stowing the hat shaping device of FIG. 3 when not in use, in accordance with aspects of the present disclosure.
Figure 22:
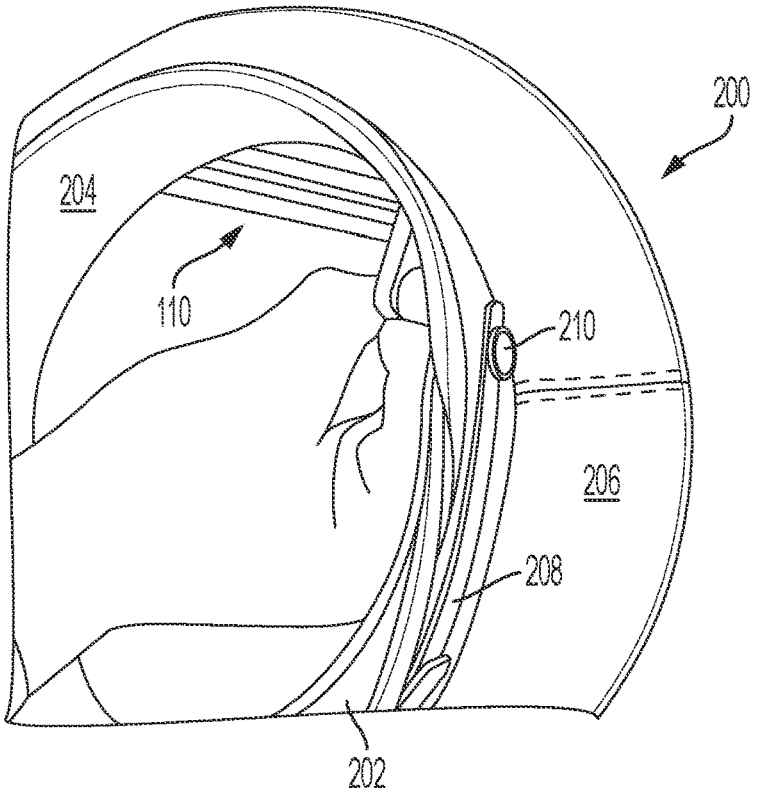
FIG. 22 is another oblique bottom view depicting another step in the illustrative method of FIG. 21.
Figure 23:
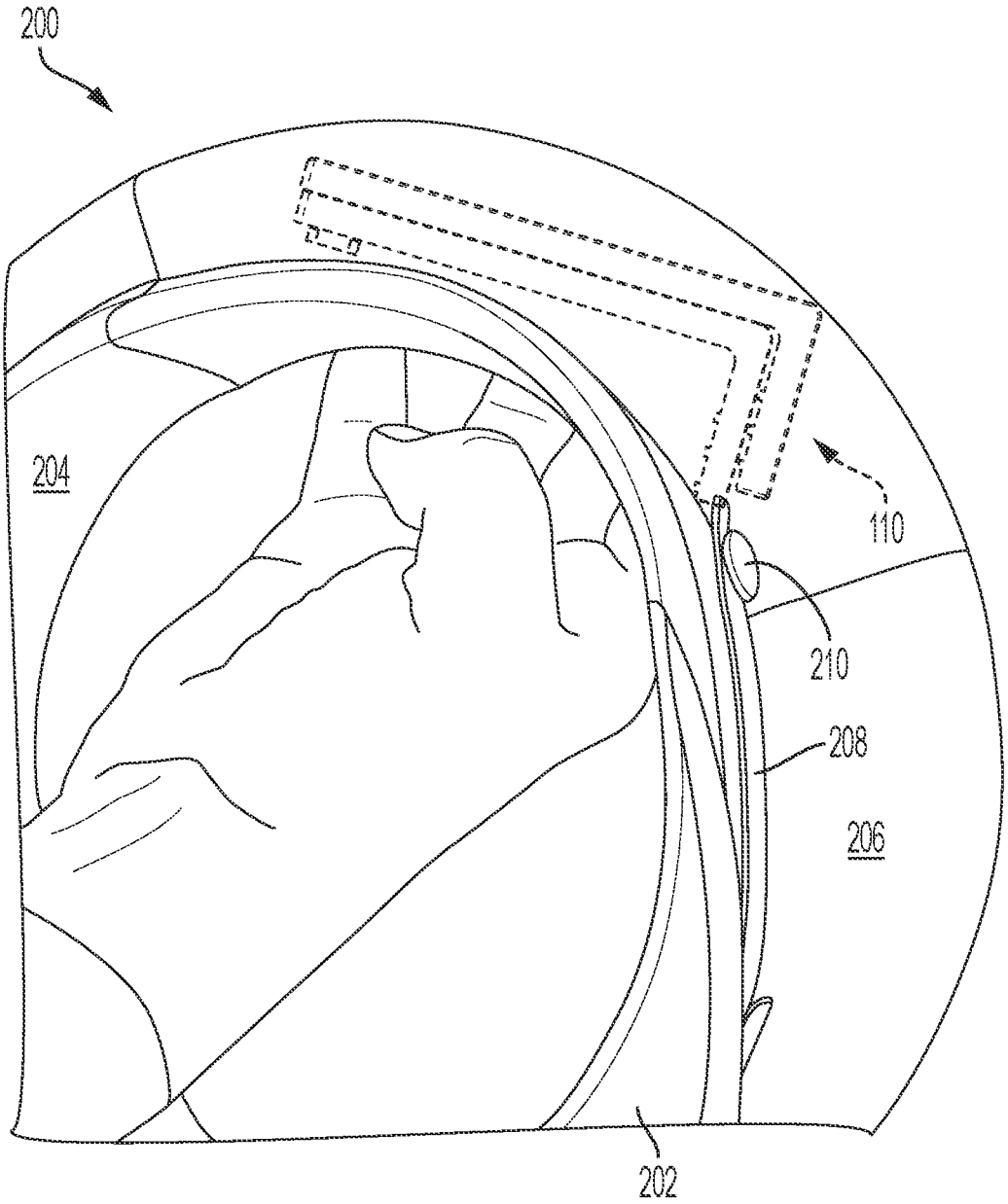
FIG. 23 is yet another oblique bottom view depicting yet another step in the illustrative method of FIG. 21.

Device 110 can be stored (e.g., in the stowed configuration) within the cap when the user is wearing the cap. FIGS. 21-23 depict an illustrative method for tucking device 110 into cap 200. FIG. 21 depicts a user inserting stowed device 110 into the head opening of cap 200. FIG. 22 depicts the user further inserting the stowed device into an outer portion of crown 206 (e.g., a portion of the crown located radially outward of band 204). FIG. 23 depicts stowed device 110 in dashed lines positioned within crown 206 outward of band 204, such that when a user dons the cap, the device would be retained within a pocket formed by the crown. In this manner, the user can transport the stowed device simply by wearing the cap, and will have the device close at hand when they remove the cap and are ready to install the device on the cap again.

C. More Examples of Hat Shaping Devices

As shown in FIGS. 10-14, this section describes additional illustrative hat shaping devices 310, 410, 510, and 610, each of which is an example of device 10.

Figure 10:
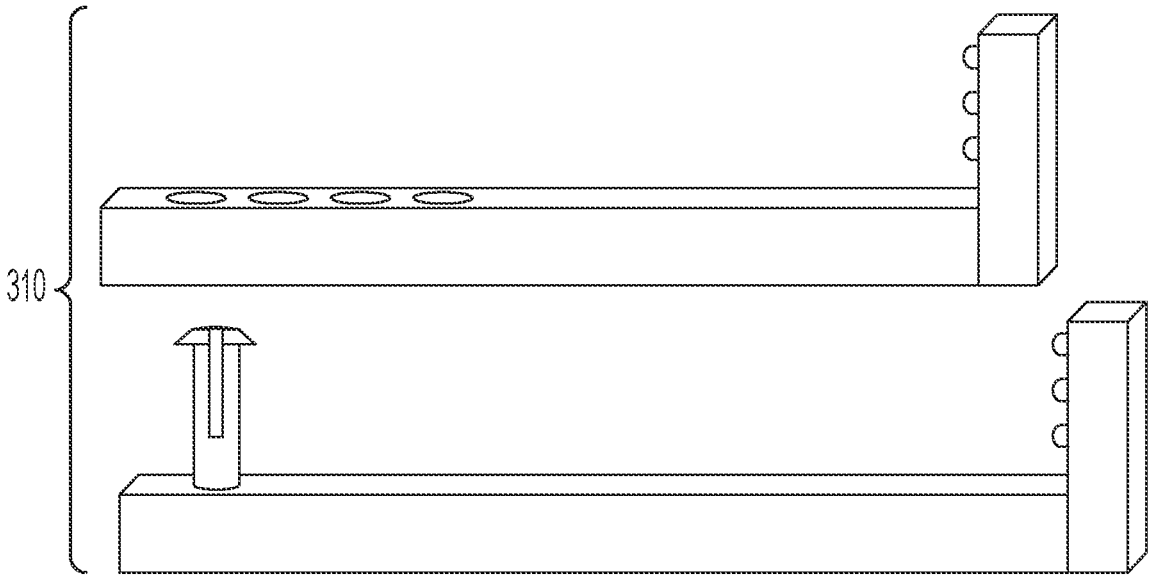
FIG. 10 is an isometric side view of another illustrative hat shaping device in accordance with aspects of the present disclosure.

FIG. 10 depicts a hat shaping device 310 having a T-shaped split pin and four apertures to choose from. Hook gripper portions are rounded knobs.

Figure 11:
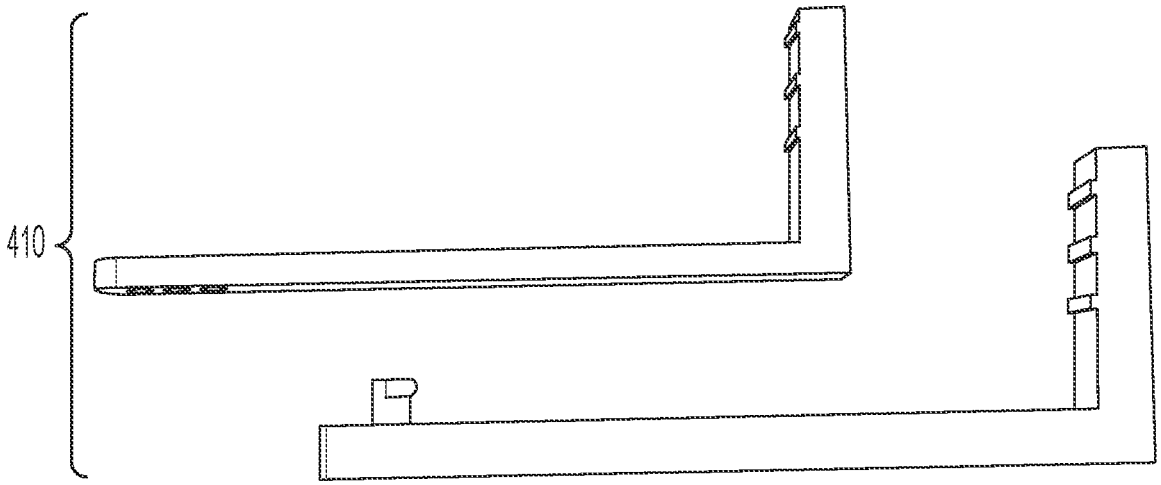
FIG. 11 is an isometric side view of yet another illustrative hat shaping device in accordance with aspects of the present disclosure.

FIG. 11 depicts a hat shaping device 410 having a rounded pin, where each leg has a different thickness. In this example, the leg including the rounded pin is thicker than the leg including the corresponding apertures.

Figure 12:
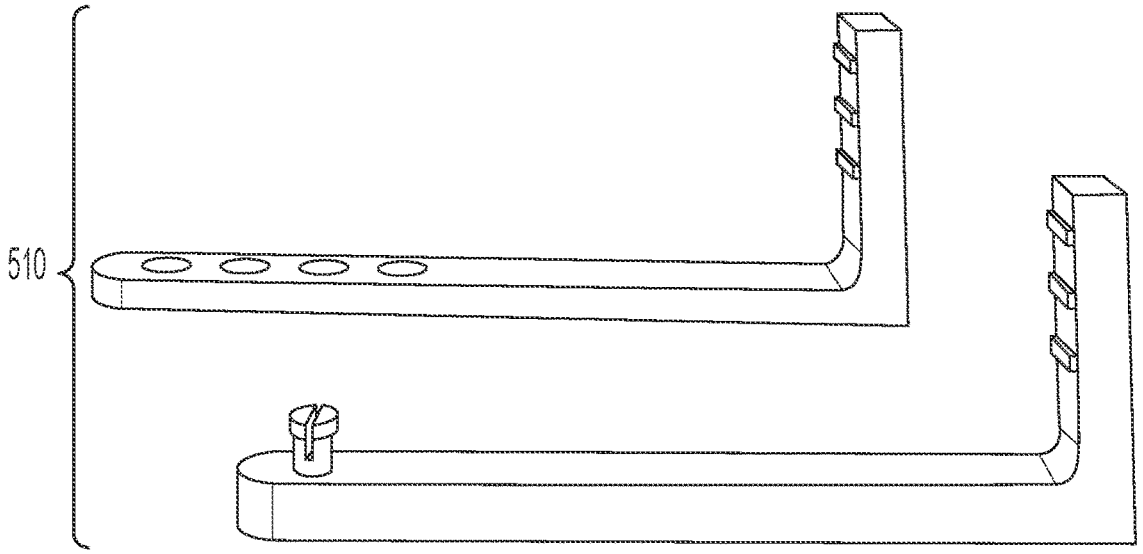
FIG. 12 is an isometric side view of yet another illustrative hat shaping device in accordance with aspects of the present disclosure.

FIG. 12 depicts a hat shaping device 510 similar to device 410, but with a split, mushroom-headed pin. The head of the pin is configured to compress (for example, the head may comprise a resilient material) when passing through an aperture narrower than the uncompressed head and then expand once through the aperture.

Figure 13:
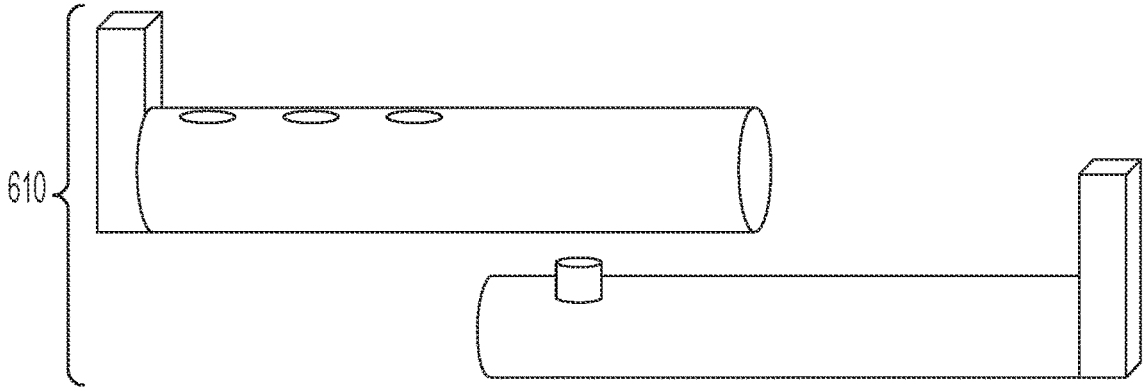
FIG. 13 is an isometric side view of yet another illustrative hat shaping device in accordance with aspects of the present disclosure, depicting the device in a disassembled configuration.

FIG. 13 depicts a disassembled hat shaping device 610 having a telescoping connection and spring-loaded pin. The leg including the spring-loaded pin is smaller in diameter than the leg having the apertures, such that the leg having the pin can be at least partially nested within the leg having the apertures. Round tubing is used for the legs in this example. In some examples, the legs of device 610 are square or rectangular tubing, and/or have any other suitable shape(s).

Figure 14:
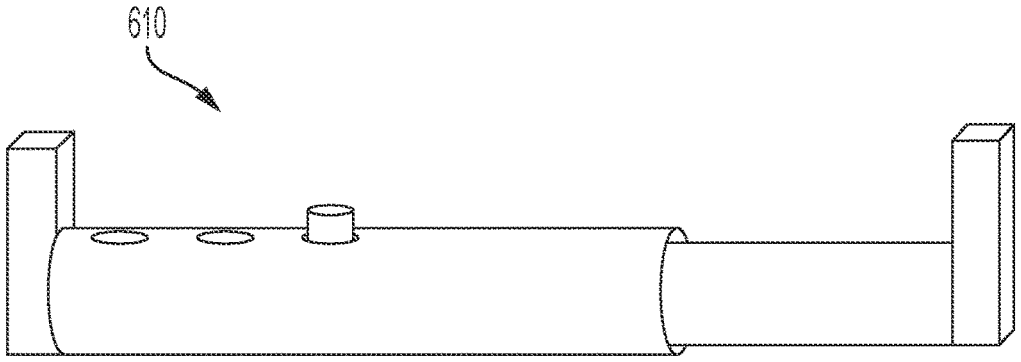
FIG. 14 is another isometric side view of the device of FIG. 13, depicting the device in an assembled configuration.

FIG. 14 depicts hat shaping device 610 of FIG. 13 in an assembled configuration, with the tubes nested and the spring-loaded pin protruding from one of the apertures.

D. Illustrative Method

Figure 24:
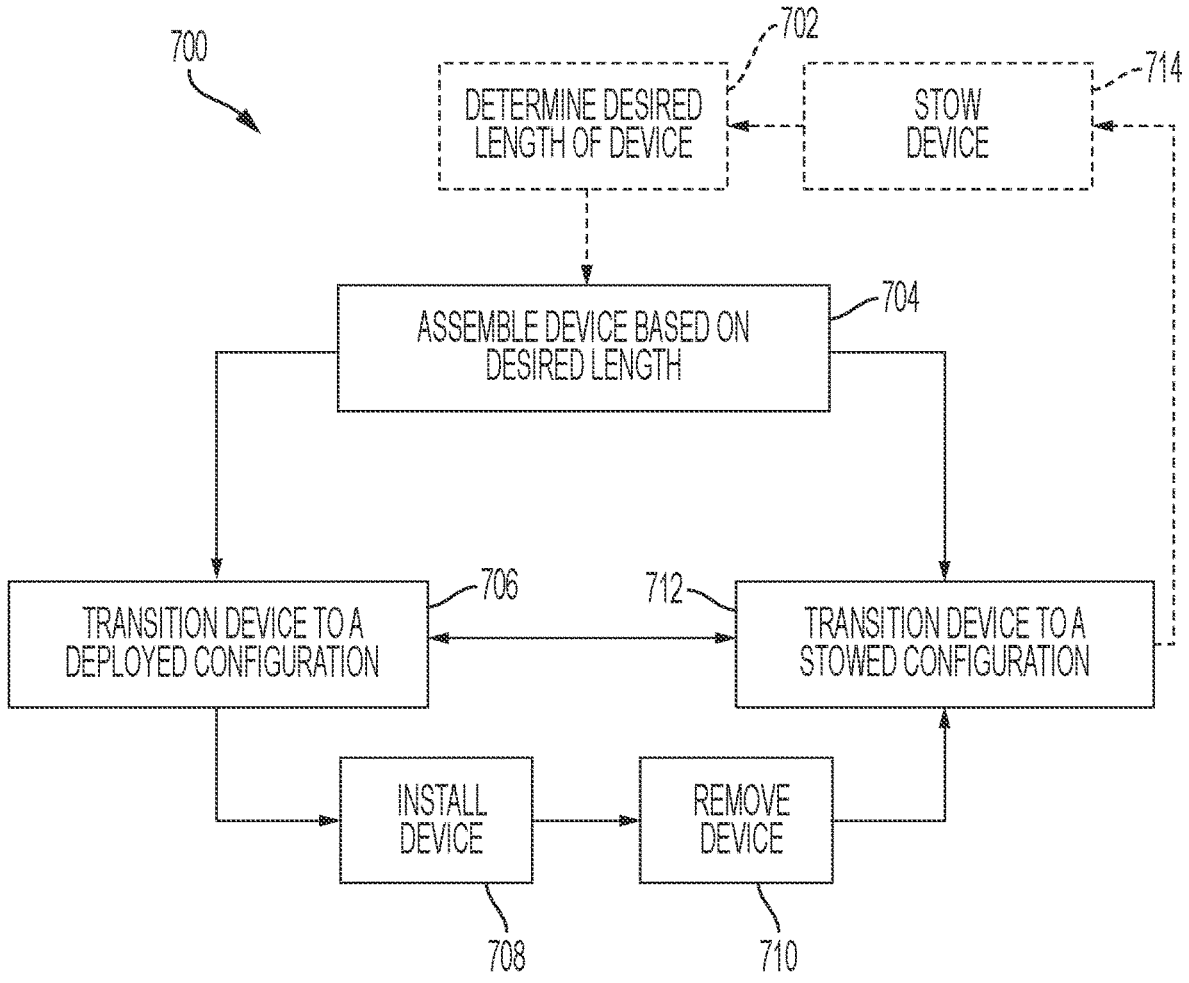
FIG. 24 is a flow chart depicting steps of an illustrative method for assembly and use of a hat shaping device according to aspects of the present disclosure.

This section describes steps of an illustrative method 700 for the assembly and use of a hat shaping device; see FIG. 24. Aspects of hat shaping devices described above may be utilized in the method steps described below. Where appropriate, reference may be made to components and systems that may be used in carrying out each step. These references are for illustration, and are not intended to limit the possible ways of carrying out any particular step of the method.

FIG. 24 is a flowchart illustrating steps performed in an illustrative method, and may not recite the complete process or all steps of the method. Although various steps of method 700 are described below and depicted in FIG. 24, the steps need not necessarily all be performed, and in some cases may be performed simultaneously or in a different order than the order shown.

Step 702 of method 700 is optional and includes determining a desired length for the hat shaping device to assume when in a deployed state. The desired length may be based on, e.g., a width of a cap on which the device is expected to be installed, a width of a head of a person expected to wear the cap, a magnitude of squeezing expected to be needed to correct the shape of the cap, and/or on any other suitable factor(s). In some examples, step 702 includes measuring, estimating, and/or otherwise obtaining a value for the width of a user's head (e.g., a distance straight across from ear to ear) to determine a desired hat width, and identifying which aperture of a plurality of apertures disposed on a leg portion of a first L-shaped hook of the device will, when coupled with a pin (e.g., a T-shaped pin) disposed on a leg portion of a second L-shaped hook of the device, cause the hat shaping device to have the desired length when in a deployed state.

Step 704 of method 700 includes assembling the hat shaping device in a configuration selected such that the device will attain a desired length (e.g., the length determined at step 702) when deployed. In some examples, assembling the device includes coupling the pin of the second hook to a selected aperture (e.g., an aperture identified at step 702) of the first hook. In some examples, the pin and aperture are configured (e.g., dimensioned) such that the pin can be inserted into the aperture only when the hooks are oriented at a particular angle(s) relative to each other. For example, the pin may be a T-shaped pin and the aperture may be shaped to receive the T-shaped pin only if the hooks are oriented perpendicular to each other. In this case, coupling the first hook to the second hook includes orienting the first and second hooks 90 degrees from each other such that the T-shaped pin and the selected aperture are aligned and inserting the T-shaped pin through the aperture.

After assembly at step 704, the hooks are coupled to each other and the device is in an intermediate stage. From the intermediate stage, the device can be transitioned to a deployed configuration (step 706) or to a stowed configuration (step 712).

Step 706 of method 700 includes transitioning the hat shaping device to the deployed configuration, in which the hooks are oriented generally antiparallel to each other (i.e., separated by 180 degrees). In examples wherein step 706 is performed when the device is in the intermediate state (e.g., immediately following step 704), step 706 includes rotating one or both of the first and second hooks such that the hooks are oriented at a 180 degree angle. For example, in cases where step 704 results in the first and second hooks being separated from each other by 90 degrees, step 706 may include rotating the first hook another 90 degrees away from the second hook, such that the hooks are 180 degrees from one another. In examples wherein step 706 is performed when the device is in a configuration other than the intermediate configuration, step 706 may include any suitable rotation of the first and/or second hook that achieves a 180 degree separation between the hooks. The length of the device in the deployed configuration is determined by the selection of aperture at step 704.

Step 708 of method 700 includes installing the hat shaping device onto a peaked cap or other suitable headgear. Step 708 is performed when the device is in the deployed configuration (e.g., following step 706). Step 708 generally includes disposing hook portions of the L-shaped hooks of the deployed hat shaping device in contact with a band of the peaked cap. To install the hook portions on the band, it may be convenient for the user to orient the cap upside down, such that a crown of the cap is generally facing the floor and an underside of the cap is facing generally upward, where the user can easily see and access it.

In some examples, step 708 includes placing a hook portion disposed at a distal end of a leg of a first hook of the device on a first lateral side of the band and placing a hook portion disposed at a distal end of a leg of a second hook of the device on an opposing lateral side of the band, such that the hook portions urge the lateral sides of the band inward to squeeze the naturally rounded band into a more oval shape. In some examples, each hook portion of the hat shaping device is placed immediately to the rear of a respective button located on respective lateral sides of the band adjacent a visor that, together with the band, forms the bottom portion of the peaked cap.

Step 710 of method 700 includes removing the hat shaping device from the peaked cap on which it is installed. In some examples, step 710 includes un-installing the device (in deployed configuration) from the peaked cap by removing both hook portions of the device from their respective lateral sides of the band, such that the hat shaping device and the peaked cap are no longer in contact with one another.

Step 712 of method 700 includes transitioning the deployed hat shaping device to a stowed configuration (e.g., by rotating one or both hooks of the device such that one hook lies on top of the other). In some examples, step 712 is performed when the device is in the deployed configuration, and step 712 includes rotating the top hook of the device 180 degrees in the direction of the bottom hook, so that the legs of the hooks lay nested one on top of the other in the stowed configuration. The stowed device has a relatively compact shape suitable for being stored (e.g., in a pocket, in the crown of a cap, and/or in any other suitable location).

In some examples, step 712 is performed when the device is in the assembled configuration (e.g., following step 704). In these examples, step 712 includes rotating the top hook (already oriented 90 degrees from the bottom leg after assembly in step 704) 90 degrees in the direction of the bottom hook (or vice versa), so that the legs of the hooks lie nested one on top of the other in the stowed configuration.

Step 714 of method 700 is optional and includes stowing the hat shaping device away (e.g., for future use). In some examples, step 714 includes stowing the device in the stowed configuration in the crown of a peaked cap, such that the device can be stored within the crown as the cap is worn. Tucking the device into the crown of the cap may include orienting the cap so that the crown portion of the cap is facing the floor and the underside of the cap faces upward, firmly holding the band of the cap with a first hand and allowing gravity to pull the crown downward to expose a cavity defined by the interior of the crown, and inserting the hat shaping device into the exposed cavity with a second hand.

In some examples, stowing the device includes either pocketing the device or storing it in an external storage container. In some examples, step 714 includes disassembling the device such that the legs of the two hooks of the device are uncoupled from one another, and placing the disassembled device in a storage location.

E. Illustrative Combinations and Additional Examples

This section describes additional aspects and features of hat shaping devices, presented without limitation as a series of paragraphs, some, or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A0. A device for maintaining a shape of a hat band and/or a cap band, the device comprising a pair of hooks each comprising a leg portion and a hook portion extending from a distal end of the respective leg portion; wherein the leg portions are configured to be coupled to each other at respective proximal ends by a joint such that the hooks are transitionable between a deployed configuration, wherein the leg portions extend in opposing directions from the joint, and a stowed configuration, wherein the leg portions extend in a same direction from the joint.

A1. The device of paragraph A0, wherein the joint is a pivoting joint, such that the hooks are configured to transition between the deployed configuration and the stowed configuration by pivoting.

A2. The device of paragraph A1, wherein a first one of the hooks is configured to pivot in a first plane and a second one of the hooks is configured to pivot in a second plane parallel to the first plane.

A3. The device of paragraph A1, wherein an underside of a first one of the leg portions engages a top side of a second one of the leg portions when the device is in the stowed configuration.

A4. The device of paragraph A1, wherein the pivoting joint includes an aperture or recess in a first one of the leg portions and a pin protruding from a second one of the leg portions, wherein the aperture or recess is configured to receive the pin to join the hooks together.

A5. The device of paragraph A4, wherein the first one of the leg portions includes a plurality of the apertures or recesses disposed at different distances from the proximal end of the first one of the leg portions, such that hooks are configured to be joined together with the pin extending into a selected one of the plurality of apertures or recesses.

A6. The device of paragraph A4, wherein the aperture or recess is a hole having a shape longer in a first dimension than in a second dimension, and a head of the pin has a corresponding shape longer in a first dimension than in a second dimension, such that the head of the pin can be passed through the hole only when the shapes of the head and the hole are aligned.

A7. The device of paragraph A1, wherein the hook portions each extend transversely from the respective leg portion.

A8. The device of paragraph A7, wherein the hook portions each extend at a 90-degree angle from the respective leg portion.

A9. The device of paragraph A0, wherein the hook portions each include one or more protrusions extending from a medial face of the hook portion.

A10. The device of paragraph A9, wherein the protrusions comprise ribs.

A11. The device of paragraph A9, wherein the protrusions comprise blocks.

B0. A collapsible device for urging a hat band into an oblong shape, the device comprising a first hook having a first leg and a first hook portion extending transversely from a distal end of the first leg; and a second hook having a second leg and a second hook portion extending transversely from a distal end of the second leg; wherein proximal ends of the first and second legs are configured to be coupled together by a pivoting joint, such that the first and second hooks are configured to pivotably transition between a first configuration, wherein the first and second legs are oriented antiparallel to each other, and a second configuration, wherein the first and second legs are oriented at an angle of less than 90 degrees relative to each other.

B1. The collapsible device of paragraph B0, wherein the first and second legs are oriented parallel to each other in the second configuration, such that the first leg is nested on the second leg.

B2. The collapsible device of paragraph B1, wherein the pivoting joint comprises a first aperture in the proximal end of the first leg and a pin projecting from the proximal end of the second leg, the pin extending through the first aperture to form the pivoting joint.

B3. The collapsible device of paragraph B2, wherein the proximal end of the first leg comprises a plurality of apertures including the first aperture, and the pin is configured to extend interchangeably through a selected one of the plurality of apertures to form the pivoting joint, such that an overall length of the device in the first configuration is determined by the selection of aperture.

B4. The collapsible device of paragraph B3, wherein each of the plurality of apertures and a head of the pin are shaped such that the head of the pin is prevented from passing through the selected aperture when the device is in the first configuration, such that the first and second hooks are locked together in the first configuration.

B5. The collapsible device of paragraph B4, wherein each of the plurality of apertures comprises an elongate slot and the head of the pin has an elongate shape oriented such that the head of the pin is oriented transverse to the elongate slot of the selected aperture in the first configuration.

C0. A method of preserving the shape of a band of a cap, the method comprising urging opposing lateral sides of the band toward each other by engaging respective outer surfaces of the lateral sides of the band using distal ends of a pair of hooks, wherein proximal ends of the hooks are coupled together.

C1. The method of paragraph C0, wherein the distal ends of the hooks comprise hook portions extending transversely from distal ends of leg portions of the hooks, and wherein medial faces of the hook portions engage the outer surfaces of the lateral sides of the band.

C2. The method of paragraph C1, wherein engaging the respective outer surfaces of the lateral sides of the band includes gripping the lateral sides of the band using a plurality of protrusions protruding from the medial faces of the hook portions.

C3. The method of paragraph C2, wherein the proximal ends of the hooks are coupled together at a pivoting joint.

C4. The method of paragraph C3, wherein the pivoting joint comprises a pin extending from the proximal end of a first one of the hooks into an opening in the proximal end of a second one of the pair of hooks.

C5. The method of paragraph C4, wherein the opening is a selected one of a plurality of openings disposed at different longitudinal positions in the proximal end of the second hook.

D0. A method of using a cap-shaping device, the method comprising installing a cap-shaping device on a cap by engaging opposing lateral surfaces of a cap band using a pair of hooks of the cap-shaping device, such that the lateral surfaces are urged toward each other; wherein the hooks are coupled to each other at proximal ends of legs of the hooks, and hook portions extend transversely from distal ends of the legs to engage the lateral surfaces of the cap band.

D1. The method of paragraph D0, wherein the hooks are coupled to each other by a pivoting joint at the proximal ends of the legs of the hooks, the method further comprising prior to installing the cap-shaping device on the cap, transitioning the cap-shaping device to a deployed configuration by pivoting one or both of the hooks about the pivoting joint such that the legs extend in opposite directions from the pivoting joint.

D2. The method of paragraph D1, wherein the pivoting joint comprises a pin extending from a first one of the hooks into an opening in a second one of the hooks.

D3. The method of paragraph D2, wherein the opening comprises a slot, and a head of the pin has an elongate shape dimensioned such that the head of the pin fits through the slot when the hooks are oriented at a first angle relative to each other and is unable to pass through the slot when the hooks are oriented at a second angle relative to each other.

D4. The method of paragraph D3, wherein the first angle is 90 degrees.

D5. The method of paragraph D4, where the second angle is 180 degrees.

D6. The method of paragraph D4, wherein the head of the pin is unable to pass through the slot when the hooks are oriented at zero degrees relative to each other.

D7. The method of paragraph D1, further comprising, after installing the cap-shaping device on the cap, removing the cap-shaping device from the cap by disengaging the hook portions from the lateral surfaces of the cap; and collapsing the cap-shaping device by pivoting one or both of the hooks about the pivoting joint such that the legs are oriented at an angle of less than 90 degrees relative to each other.

D8. The method of paragraph D7, wherein the angle is approximately zero degrees, such that the legs extend in a same direction.

D9. The method of paragraph D8, wherein one leg is disposed on top of the other leg when the legs are oriented at the angle.

D10. The method of paragraph D8, further comprising, after collapsing the cap-shaping device, disposing the collapsed cap-shaping device inside the cap.

D11. The method of paragraph D10, wherein disposing the collapsed cap-shaping device inside the cap includes disposing the collapsed cap-shaping device in a pocket defined by a portion of a crown of the cap, such that a wearer can wear the cap while the collapsed cap-shaping device is stored in the pocket.

D12. The method of paragraph D0, further comprising, prior to installing the cap-shaping device on the cap, coupling the hooks to each other at the proximal ends of the legs of the hooks.

D13. The method of paragraph D12, wherein coupling the hooks to each other includes inserting a pin extending from the proximal end of a first one of the hooks into an opening in the proximal end of a second one of the hooks.

D14. The method of paragraph D13, wherein the opening is a selected one of a plurality of openings disposed at different longitudinal positions along the proximal end of the second one of the hooks, the method further comprising selecting the opening from the plurality of openings based a desired distance to be achieved between the hook portions of the hooks.

D15. The method of paragraph D0, wherein the legs of the hooks are configured to telescopingly collapse together.

D16. The method of paragraph D15, wherein a first one of the legs has an opening and a second one of the legs has a spring-loaded pin configured to be received in the opening to secure the legs together.

D17. The method of paragraph D16, wherein the opening is a selected one of a plurality of openings in the first leg, the method further comprising selecting the opening from the plurality of openings based on a desired distance between the hook portions of the hooks.

E0. A collapsible device for urging a hat band into an oblong shape, the device comprising a first hook having a first leg and a first hook portion extending transversely from a distal end of the first leg; and a second hook having a second leg and a second hook portion extending transversely from a distal end of the second leg; wherein the first leg is configured to telescopingly collapse into the second leg.

E1. The collapsible device of paragraph E0, wherein the second leg has a plurality of openings disposed at different respective longitudinal distances and the first leg has a spring-loaded pin configured to be received in a selected one of the openings.

Advantages, Features, and Benefits

The different embodiments and examples of the hat shaping device described herein provide several advantages over known solutions for maintaining a desired shape of a hat band. For example, illustrative embodiments and examples described herein provide a durable, portable, reusable device for maintaining the shape of a peaked cap.

Additionally, and among other benefits, illustrative embodiments and examples described herein have a more substantial and professional appearance than known home-made solutions.

Additionally, and among other benefits, illustrative embodiments and examples described herein are collapsible (e.g., foldable, pivotable, and/or telescoping) to enable carrying the device in a pocket or stowed in the hat itself.

Additionally, and among other benefits, illustrative embodiments and examples described herein have nesting parts that make the device more portable and less likely to catch on other objects or become awkward to carry.

Additionally, and among other benefits, illustrative embodiments and examples described herein are simple to manufacture; assembly, use, and disassembly are also straightforward for the user.

Additionally, and among other benefits, illustrative embodiments and examples described herein have several surfaces on which branding, messaging, and/or affiliation symbology (e.g., a U.S. Marine Corps emblem) can be displayed (e.g., by engraving, molding, printing, etc.).

No known system or device can perform these functions. However, not all embodiments and examples described herein provide the same advantages or the same degree of advantage.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

The invention claimed is:

1. A device for maintaining a shape of a hat band, the device comprising:

a pair of hooks each comprising a leg portion and a hook portion extending from a distal end of the respective leg portion; and a pivoting joint including a hole in a first one of the leg portions and a pin protruding from a second one of the leg portions, the hole configured to receive the pin to loin the hooks;

wherein the hole has a shape longer in a first dimension than in a second dimension, and a head of the pin has a corresponding shape longer in the first dimension than in the second dimension, such that the head of the pin can be passed through the hole only when the shapes of the head and the hole are aligned; and wherein the leg portions are configured to be coupled to each other at respective proximal ends by the pivoting joint such that the hooks are pivotably transitionable between a deployed configuration, wherein the leg portions extend in opposing directions from the joint, and a stowed configuration, wherein the leg portions extend in a same direction from the joint.

2. The device of claim 1, wherein a first one of the hooks is configured to pivot in a first plane and a second one of the hooks is configured to pivot in a second plane parallel to the first plane.

3. The device of claim 1, wherein an underside of the first one of the leg portions engages a top side of the second one of the leg portions when the device is in the stowed configuration.

4. The device of claim 1, wherein the hole is a first hole and the first one of the leg portions includes a plurality of holes including the first hole, and the plurality of holes are disposed at different distances from the proximal end of the first one of the leg portions, such that the hooks are configured to be joined together with the pin extending into a selected one of the plurality of holes.

5. The device of claim 1, wherein the hook portions each extend transversely from the respective leg portion.

6. The device of claim 5, wherein the hook portions each extend at a 90-degree angle from the respective leg portion.

7. The device of claim 1, wherein the hook portions each include one or more protrusions extending from a medial face of the hook portion.

8. The device of claim 7, wherein the protrusions comprise ribs.

9. The device of claim 7, wherein the protrusions comprise blocks.

10. A collapsible device for urging a hat band into an oblong shape, the device comprising:

a first hook having a first leg and a first hook portion extending transversely from a distal end of the first leg;

a second hook having a second leg and a second hook portion extending transversely from a distal end of the second leg; and a pivoting joint comprising a first aperture in a proximal end of the first leg and a pin projecting from a proximal end of the second leg, the pin extending through the first aperture to form the pivoting joint and couple the proximal ends of the first and second legs together, such that the first and second hooks are configured to pivotably transition between a first configuration, wherein the first and second legs are oriented antiparallel to each other, and a second configuration, wherein the first and second legs are oriented parallel to each other, such that the first leg is nested on the second leg;

wherein the proximal end of the first leg comprises a plurality of apertures including the first aperture, and the pin is configured to extend interchangeably through a selected one of the plurality of apertures to form the pivoting joint, such that an overall length of the device in the first configuration is determined by the selection of an aperture; and wherein each of the plurality of apertures and a head of the pin are shaped such that the head of the pin is prevented from passing through the selected aperture when the device is in the first configuration, such that the first and second hooks are locked together in the first configuration.

11. The collapsible device of claim 10, wherein each of the plurality of apertures comprises an elongate slot and the head of the pin has an elongate shape oriented such that the head of the pin is oriented transverse to the elongate slot of the selected aperture in the first configuration.

* * * * *